US010912330B2

(12) United States Patent
Malgat et al.

(10) Patent No.: US 10,912,330 B2
(45) Date of Patent: Feb. 9, 2021

(54) ELECTRICALLY OPERATED AEROSOL GENERATING SYSTEM WITH THERMAL SPREADING WRAP

(71) Applicant: Philip Morris Products S.A., Neuchatel (CH)

(72) Inventors: Alexandre Malgat, Les Tuileries de Grandson (CH); Stephane Roudier, Colombier (CH); Ana Carolina Borges De Couraca, Lausanne (CH); Frederic Lavanchy, Chavornay (CH); Cedric Meyer, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/724,002

(22) Filed: Dec. 20, 2019

(65) Prior Publication Data

US 2020/0120978 A1 Apr. 23, 2020

Related U.S. Application Data

(63) Continuation of application No. 15/101,223, filed as application No. PCT/EP2014/076646 on Dec. 4, 2014, now abandoned.

(30) Foreign Application Priority Data

Dec. 5, 2013 (EP) ..... 13195877

(51) Int. Cl.
*A24F 40/20* (2020.01)
*A24F 40/00* (2020.01)
(Continued)

(52) U.S. Cl.
CPC ..... *A24F 40/20* (2020.01); *A24B 3/14* (2013.01); *A24D 1/20* (2020.01); *A24F 40/00* (2020.01); *A24F 47/008* (2013.01); *A24D 1/025* (2013.01)

(58) Field of Classification Search
CPC ..... A24F 40/20; A24F 47/008; A24D 1/20; A24D 1/10; A24D 1/025; B32B 2307/3065
See application file for complete search history.

(56) References Cited

U.S. PATENT DOCUMENTS 2,718,889 A 9/1955 Claussen
3,258,015 A 6/1966 Ellis
(Continued)

FOREIGN PATENT DOCUMENTS

CH 691 156 A5 5/2001
CN 1087497 A 6/1994
(Continued)

OTHER PUBLICATIONS

International Search Report and Written Opinion of the International Searching Authority dated Mar. 3, 2015 in PCT/EP2014/076646.
(Continued)

*Primary Examiner* — Joseph S Del Sole
*Assistant Examiner* — Jerzi H Moreno Hernandez
(74) *Attorney, Agent, or Firm* — Oblon, McClelland, Maier & Neustadt, L.L.P.

(57) ABSTRACT

An electrically operated aerosol-generating system is provided, including an aerosol-generating device including an electrically powered heating element; and a heated aerosol-generating article including an aerosol-forming substrate radially encircled by a sheet of thermally-conductive material, which is a thermally conducting flame barrier config-
(Continued)

ured to spread heat and to mitigate against a risk of igniting the substrate by application of a flame to the article, and a plurality of elements, assembled together with the substrate within a wrapper to form a rod having a mouth end and a distal end upstream from the mouth end, the substrate being disposed at the distal end of the rod, the elements including a spacer element disposed within the rod downstream of the substrate and a mouthpiece element extending upstream from the mouth end of the rod, the device being configured to receive the article and the heating element is configured to heat the substrate of the article.

16 Claims, 4 Drawing Sheets

(51) Int. Cl.

| | |
|---|---|
| ***A24D 1/20*** | (2020.01) |
| ***A24F 47/00*** | (2020.01) |
| ***A24B 3/14*** | (2006.01) |
| *A24D 1/02* | (2006.01) |

(56) References Cited

U.S. PATENT DOCUMENTS

| | | | | |
|---|---|---|---|---|
| 4,047,536 | A | 9/1977 | Asfour | |
| 4,807,809 | A | 2/1989 | Pryor | |
| 4,966,141 | A | 10/1990 | Bacaner et al. | |
| 5,018,536 | A | 5/1991 | Liebich | |
| 5,042,510 | A | 8/1991 | Curtiss | |
| 5,105,831 | A | 4/1992 | Banerjee et al. | |
| 5,240,012 | A | 8/1993 | Ehrman et al. | |
| 5,247,947 | A | 9/1993 | Clearman | |
| 5,269,327 | A | 12/1993 | Counts et al. | |
| 5,388,594 | A | 2/1995 | Counts | |
| 5,499,636 | A * | 3/1996 | Baggett, Jr. | A24F 47/008 131/194 |
| 5,996,589 | A * | 12/1999 | St. Charles | A24F 47/002 131/273 |
| 6,129,087 | A | 10/2000 | Wallace et al. | |
| 6,367,481 | B1 | 4/2002 | Nichols | |
| 6,598,607 | B2 | 7/2003 | Adiga et al. | |
| 2003/0075188 | A1* | 4/2003 | Adiga | A24F 47/004 131/185 |
| 2007/0002305 | A1 | 1/2007 | Lehre et al. | |
| 2007/0023056 | A1 | 2/2007 | Cantrell et al. | |
| 2007/0102013 | A1* | 5/2007 | Adams | A24F 47/008 131/273 |
| 2007/0215167 | A1 | 9/2007 | Crooks et al. | |
| 2009/0320865 | A1 | 12/2009 | Ning | |
| 2010/0059070 | A1* | 3/2010 | Potter | A24F 47/004 131/194 |
| 2010/0200006 | A1 | 8/2010 | Robinson | |
| 2011/0126848 | A1 | 6/2011 | Zuber | |
| 2011/0192408 | A1 | 8/2011 | Inagaki et al. | |
| 2011/0290269 | A1* | 12/2011 | Shimizu | A24F 47/004 131/330 |
| 2012/0006346 | A1 | 1/2012 | Inagaki | |
| 2013/0061861 | A1 | 3/2013 | Heam | |
| 2013/0133675 | A1 | 5/2013 | Shinozaki | |
| 2013/0146075 | A1 | 6/2013 | Poget | |
| 2013/0306085 | A1 | 11/2013 | Sanchez | |
| 2014/0000638 | A1 | 1/2014 | Sebastian | |
| 2015/0027458 | A1 | 1/2015 | Grant | |
| 2016/0309781 | A1 | 10/2016 | Malgat | |
| 2016/0309782 | A1 | 10/2016 | Malgat | |

FOREIGN PATENT DOCUMENTS

| | | | |
|---|---|---|---|
| CN | 102762118 | A | 10/2012 |
| EP | 0 337 505 | A2 | 10/1989 |
| EP | 0 358 002 | | 3/1990 |
| EP | 0 430 559 | A2 | 6/1991 |
| EP | 0 503 767 | | 9/1992 |
| EP | 0 822 670 | A2 | 2/1998 |
| EP | 2 368 449 | A1 | 9/2011 |
| EP | 2 625 974 | A1 | 8/2013 |
| GB | 1 509 278 | A | 5/1978 |
| JP | 60-164472 | A | 8/1985 |
| RU | 110 607 | U1 | 11/2011 |
| RU | 121 703 | U1 | 11/2012 |
| WO | 2008/108889 | A1 | 9/2008 |
| WO | WO 2009/022232 | A2 | 2/2009 |
| WO | 2009/118085 | A1 | 10/2009 |
| WO | WO 2009/118085 | A1 | 10/2009 |
| WO | WO 2010/047389 | A1 | 4/2010 |
| WO | WO 2011/050964 | A1 | 5/2011 |
| WO | WO 2011/117580 | A2 | 9/2011 |
| WO | WO 2012-164009 | A2 | 12/2012 |
| WO | WO 2013/120849 | A1 | 4/2013 |
| WO | 2013/104616 | A1 | 7/2013 |
| WO | WO 2013/098405 | A2 | 7/2013 |
| WO | WO 2013/102614 | A2 | 7/2013 |
| WO | WO 2013/104616 | A1 | 7/2013 |

OTHER PUBLICATIONS

International Search Report and Written Opinion dated Mar. 3, 2015 in PCT/EP2014/076646.
Written Opinion dated Nov. 9, 2015 in PCT/EP2014/076646.
International Preliminary Report on Patentability dated Feb. 25, 2016 in PCT/EP2014/076646.
Extended European Search Report dated May 14, 2014 in Patent Application No. 13195877.9.
Russian Notice of Allowance dated Jun. 18, 2018 in Russian Patent Application No. 2016126592 (submitting English translation only), 5 pages.
Office Action dated Oct. 9, 2018 in Japanese Patent Application No. 2016-533686, 13 pages (with English language translation).
Combined Office Action and Search Report dated Jan. 4, 2019 in Chinese Patent Applicalion No. 201480064049.1, 19 pages.
European Search Report dated Nov. 4, 2019 in corresponding European Divisional Patent Application No. 19186160.8, (7 pages).

* cited by examiner

ELECTRICALLY OPERATED AEROSOL GENERATING SYSTEM WITH THERMAL SPREADING WRAP

CROSS-REFERENCE TO RELATED APPLICATIONS

This application is a continuation application of and claims the benefit of priority under 35 U.S.C. § 120 to U.S. application Ser. No. 15/101,223, filed on Jun. 2, 2016, which is a U.S. National Stage application of PCT/EP2014/076646, filed on Dec. 4, 2014, and claims benefit of priority under 35 U.S.C. § 119 to EP 13195877.9, filed on Dec. 5, 2013, the entire contents of each of which are incorporated herein by reference.

The present specification relates to heated aerosol-generating articles for se with an aerosol-generating device comprising a heating element, the articles having a lowered propensity for ignition, for example when brought into contact with a flame. The specification also relates to rods having a lowered propensity for ignition.

Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in conventional cigarettes. A conventional cigarette is lit when a user applies a flame to one end of the cigarette and draws air through the other end. The localised heat provided by the flame and the oxygen in the air drawn through the cigarette cause the end of the cigarette to ignite, and the resulting combustion generates an inhalable smoke. By contrast in heated aerosol-generating articles, an inhalable aerosol is typically generated by the transfer of heat from a heat source to a physically separate aerosol-forming substrate or material, which may be located within, around or downstream of the heat source. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Heated aerosol-generating articles comprising tobacco for generation of an aerosol by heating rather than burning are known in the art. For example, WO2013/102614 discloses an aerosol-generating system comprising a heated aerosol-generating article and an aerosol generating device having a heater for heating the heated aerosol-generating article to produce an aerosol.

Tobacco used as part of an aerosol-forming substrate in heated aerosol-generating articles is designed to produce an aerosol when heated rather than when burned. Thus, such tobacco typically contains high levels of aerosol formers, such as glycerine or propylene glycol. If a user were to light a heated aerosol-generating article and smoke it as if it were a conventional cigarette that user would not receive the intended user experience. It would be desirable to produce a heated aerosol-generating article that has a lowered propensity for flame ignition. Such a heated aerosol-generating article would be preferably difficult to light during attempts to light the article with a lighter, such as a flame, in the manner of traditional cigarettes.

A heated aerosol-generating article may be provided comprising an aerosol-forming substrate radially encircled by a sheet of thermally-conductive material. The heated aerosol-generating article is for use with an electrically-operated aerosol-generating device comprising a heating element. If a heat source, such as a flame or other cigarette lighter, is applied to the aerosol-forming substrate, the thermally-conductive material that encircles the aerosol-forming substrate conducts a portion of the heat away from the point of contact with the heat source. Thus, more thermal energy needs to be supplied in order to raise the temperature of the aerosol-forming substrate to its ignition point. This reduces the propensity for ignition of the aerosol-forming substrate. Thus, the thermally-conductive material may act as a thermally-conducting flame barrier for spreading heat and mitigating against the risk of a user igniting the aerosol-forming substrate by applying a flame, or other ignition source, to the aerosol-generating article. The heated aerosol-generating article is not an aerosol-generating article comprising a combustible heat source.

Preferably, the aerosol-generating article is a smoking article that generates an aerosol that is directly inhalable into a user's lungs through the user's mouth. More, preferably, the aerosol-generating article is a smoking article that generates a nicotine-containing aerosol that is directly inhalable into a user's lungs through the user's mouth.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

For the avoidance of doubt, the term 'heating element' is used to mean one or more heating elements.

The thermally-conductive material is preferably a non-flammable material. The thermally-conductive material is preferably a metal foil, such as aluminium foil. The thermally-conductive material may comprise a metal foil, such as aluminium foil. For example, the thermally-conductive material may be a co-laminated sheet comprising aluminium foil and a second material such as paper or homogenised tobacco. Aluminium foil is a highly efficient thermal conductor either on its own or as a layer in a co-laminated sheet.

The heated aerosol-generating article may comprise a plurality of elements, including the aerosol-forming substrate, assembled within a wrapper, such as a cigarette paper, to form a rod. The sheet of thermally-conductive material may be located within the cigarette paper. That is, the sheet of thermally-conductive material may be arranged to radially encircle the aerosol-forming substrate, and the radially-encircled aerosol-forming substrate is assembled within the wrap per. Alternatively, the sheet of thermally-conductive material may be radially external to the wrap per. That is, the aerosol-forming substrate may be assembled within the wrapper, and then the sheet of thermally-conductive material encircles both the aerosol-forming substrate and at least a portion of the wrapper.

The heated aerosol-generating article may be in the form of a rod having a mouth end and a distal end upstream from the mouth end, in which a portion of the thermally-conductive material covers the distal end of the rod.

The heated aerosol-generating article may be in the form of a rod having a mouth end and a distal end upstream from the mouth end, in which a spacer element is located within the rod upstream of the aerosol-forming substrate.

The heated aerosol-generating article may be in the form of a rod having a mouth end and a distal end upstream from the mouth end, in which the aerosol-forming substrate is located at the distal end of the rod.

In preferred embodiments of a heated aerosol-forming article, the aerosol-forming substrate may comprise a gathered sheet of aerosol-forming material circumscribed by a wrapper. The wrapper may be the sheet of thermally-conductive material. The gathered sheet of aerosol-forming material may be a sheet of tobacco such as a sheet of homogenised tobacco.

The aerosol-forming substrate may be formed as a rod of cut filler, and the rod of cut filler may be encircled by a sheet of thermally-conductive material.

The heated aerosol-generating article is preferably for use with an aerosol-generating device that comprises an insertable heating element for insertion into a distal end of the heated aerosol-generating article. The heating element may be brought into contact with the aerosol-forming substrate within the aerosol-generating article, while the thermally-conductive material provides some mitigation against ignition of the aerosol-forming substrate using an external ignition source such as a flame.

The aerosol-forming substrate may be in the form of a rod comprising aerosol-forming material. A rod may be provided comprising a gathered sheet of aerosol-forming material circumscribed by a wrapper, in which the wrapper is a sheet of thermally-conductive material. Such a rod may be assembled within a cigarette paper, or other suitable material, as an aerosol-forming substrate of an aerosol-generating article.

The wrapper circumscribing the gathered sheet of aerosol-forming material may be a metal foil, or may comprise a metal foil. For example, the wrapper may be aluminium foil or a co-laminated sheet comprising a layer of aluminium foil.

Preferably the sheet of aerosol-forming material comprises tobacco, for example tobacco that may be classed as homogenised, reconstituted or cast leaf tobacco.

The gathered sheet of material preferably extends along substantially the entire rod length of the rod and across substantially the entire transverse cross-sectional area of the rod.

A rod as described above may be particularly beneficial as a component of a heated aerosol-generating article. The thermally-conductive wrapper has an increased thermal conductivity compared to traditional paper wrappers, which makes it more difficult to ignite. Thus, a user who applies a flame to such a rod when forming part of a heated aerosol-generating article may experience difficulty in igniting the aerosol-forming material. The user may therefore be discouraged from smoking the aerosol-generating article in an unintended way.

Preferably, rods according to the specification are of substantially uniform cross-section.

Rods according to the specification may be produced having different dimensions depending upon their intended use.

For example, rods according to the specification may have a diameter of between about 5 mm and about 10 mm depending upon their intended use.

For example, rods according to the specification may have a rod length of between about 5 mm and about 150 mm depending upon their intended use.

In preferred embodiments, rods according to the specification for use as aerosol-forming substrates in heated aerosol-generating articles may have a rod length of between about 5 mm and about 20 mm or about 30 mm.

Rods according to the specification of a desired unit rod length may be produced by forming a rod of multiple unit rod length and then cutting or otherwise dividing the rod of multiple unit rod length into multiple rods of the desired unit rod length.

For example, rods having a rod length of about 15 mm for use as aerosol-forming substrates in heated aerosol-generating articles may be produced by forming a rod having a rod length of about 150 mm and then severing the elongate rod into ten rods having a rod length of about 15 mm.

As used herein, the term 'rod' is used to denote a generally cylindrical element of substantially circular, oval or elliptical cross-section.

As used herein, the term 'sheet' denotes a laminar element having a width and length substantially greater than the thickness thereof. The width of a sheet is greater than 10 mm, preferably greater than 20 mm or 30 mm.

As used herein, the term "co-laminated sheet" denotes a single sheet formed from two or more layers of material in intimate contact with one another.

As used herein, the term "aerosol-forming material" denotes a material that is capable of releasing volatile compounds upon heating to generate an aerosol. An aerosol-forming substrate may comprise or consist of an aerosol-forming material.

As used herein, the term 'rod length' denotes the dimension in the direction of the cylindrical axis of rods as described herein.

As used herein, the term 'homogenised tobacco material' denotes a material formed by agglomerating particulate tobacco.

As used herein, the term 'gathered' denotes that the sheet of tobacco material is convoluted, folded, or otherwise compressed or constricted substantially transversely to the cylindrical axis of the rod.

As used herein, the terms 'upstream' and 'downstream' are used to describe the relative positions of components, or portions of components, of aerosol-generating articles comprising rods as described herein in relation to the direction of air drawn through the aerosol-generating articles during use thereof.

The gathered sheet of aerosol-forming material may be a textured sheet of material. Use of a textured sheet of material may advantageously facilitate gathering of the sheet to form a rod as described herein.

As used herein, the term 'textured sheet' denotes a sheet that has been crimped, embossed, debossed, perforated or otherwise deformed. Textured sheets of material may comprise a plurality of spaced-apart indentations, protrusions, perforations or a combination thereof.

As used herein, the term 'crimped sheet' is intended to be synonymous with the term 'creped sheet' and denotes a sheet having a plurality of substantially parallel ridges or corrugations.

A number of aerosol-generating articles in which an aerosol-forming substrate is heated rather than combusted have been proposed in the art. Typically in heated aerosol-generating articles, an aerosol is generated by the transfer of heat from a heat source, for example a chemical, electrical or combustible heat source, to a physically separate aerosol-forming substrate, which may be located within, around or downstream of the heat source.

As used herein, the term 'aerosol-forming substrate' denotes a substrate consisting of or comprising an aerosol-forming material that is capable of releasing volatile compounds upon heating to generate an aerosol.

Rods as described herein are particularly suited for use as aerosol-forming substrates of heated aerosol-generating articles. Aerosol-forming substrates in heated aerosol-generating articles are typically significantly shorter in rod length than rods of combustible smokable material in conventional lit-end smoking articles.

In one embodiment, rods as described herein may be used as aerosol-forming substrates in heated aerosol-generating articles comprising a combustible heat source and an aerosol-generating substrate downstream of the combustible heat source.

For example, rods as described herein may be used as aerosol-generating substrates in heated aerosol-generating articles of the type disclosed in WO-A-2009/022232, which comprise a combustible carbon-based heat source, an aerosol-generating substrate downstream of the combustible heat source, and a heat-conducting element around and in contact with a rear portion of the combustible carbon-based heat source and an adjacent front portion of the aerosol-generating substrate. However, it will be appreciated that rods as described herein may also be used as aerosol-generating substrates in heated aerosol-generating articles comprising combustible heat sources having other constructions.

In another embodiment, rods as described herein may be used as aerosol-generating substrates in heated aerosol-generating articles for use in electrically-operated aerosol-generating systems in which the aerosol-generating substrate of the heated aerosol-generating article is heated by an electrical heat source. Aerosol-generating articles as described herein are also preferably for use with electrically-operated aerosol-generating systems in which the aerosol-generating substrate of the heated aerosol-generating article is heated by an electrical heat source. Such heated aerosol-generating articles are frequently constructed having an aerosol-forming substrate at a distal end. Thus, a user may inadvertently attempt to light the article in a traditional manner. The reduced ignition propensity of heated aerosol-generating articles in which the aerosol-forming substrate is encircled by a sheet of thermally-conductive material may advantageously dissuade a user from attempting to ignite the article.

As an example, rods as described herein may be used as aerosol-generating substrates in heated aerosol-generating articles of the type disclosed in EP-A-0 822 670.

A system may be provided comprising an electrically-operated aerosol-generating apparatus and an aerosol-generating article for use with the apparatus. The aerosol-generating article is any heated aerosol-generating article as described herein.

Preferred embodiments of aerosol-generating articles comprise gathered sheets of homogenised tobacco material as the aerosol-forming substrate. In certain embodiments, sheets of homogenised tobacco material may have a tobacco content of at least about 40% by weight on a dry weight basis or of at least about 50% by weight on a dry weight basis. In other embodiments, sheets of homogenised tobacco material may have a tobacco content of about 70% or more by weight on a dry weight basis. The use of sheets of homogenised tobacco material having high tobacco content advantageously generates aerosols with enhanced tobacco flavour.

Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose: polysaccharides such as, for example, starches, organic acids, such as alginic acid, conjugate base salts of organic acids, such as sodium-alginate, agar and pectins; and combinations thereof.

Homogenised tobacco material may comprise between about 1% and about 5% non-tobacco fibres by weight on a dry weight basis.

Suitable aerosol-formers and humectants for inclusion in sheets of homogenised tobacco material are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, sheets of homogenised tobacco material may have an aerosol former content of between about 5% and about 30% by weight on a dry weight basis. Heated aerosol-generating articles may preferably include homogenised tobacco having an aerosol former content of greater than 5% to about 30%. The aerosol former may preferably be glycerine.

Sheets of homogenised tobacco material for use in forming heated aerosol-generating articles or rods as described herein are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

For example, in certain embodiments sheets of homogenised tobacco material may be formed from slurry comprising particulate tobacco, guar gum, cellulose fibres and glycerine by a casting process.

Sheets of homogenised tobacco material may be textured using suitable known machinery for texturing filter tow, paper and other materials.

For example, sheets of homogenised tobacco material may be crimped using a crimping unit of the type described in CH-A-691156, which comprises a pair of rotatable crimping rollers. However, it will be appreciated that sheets of homogenised tobacco material may be textured using other suitable machinery and processes that deform or perforate the sheets of homogenised tobacco material.

Preferably, sheets of tobacco material for use in rods as described herein have a width of at least about 25 mm. In certain embodiments sheets of material may have a width of between about 25 mm and about 300 mm. Preferably, the sheets of material have a thickness of at least about 50 μm to about 300 μm.

In certain embodiments, individual sheets of material may have a thickness of between 10 μm and about 250 μm. In certain embodiments, sheets of homogenised tobacco material may have a grammage 100 g/m$^2$ and about 300 g/m$^2$.

A method may be provided of forming a rod as described herein. The rod may be used as an aerosol-forming substrate in a heated aerosol-generating article. The method may comprise the steps of: providing a continuous sheet comprising an aerosol-forming material; gathering the sheet transversely relative to the longitudinal axes thereof; circumscribing the gathered sheet with a wrapper to form a continuous rod, and severing the continuous rod into a plurality of discrete rods. The aerosol-forming material may be any aerosol-forming material described above, and is preferably homogenised tobacco. In certain embodiments the wrapper is any thermally conductive material described above, and is preferably an aluminium foil.

The method may further comprise texturing the continuous sheet. For example, the method may comprise crimping, embossing, perforating or otherwise texturing the continuous sheet prior to gathering.

Specific embodiments will be further described, by way of example only, with reference to the accompanying drawings in which.

Figure 1:
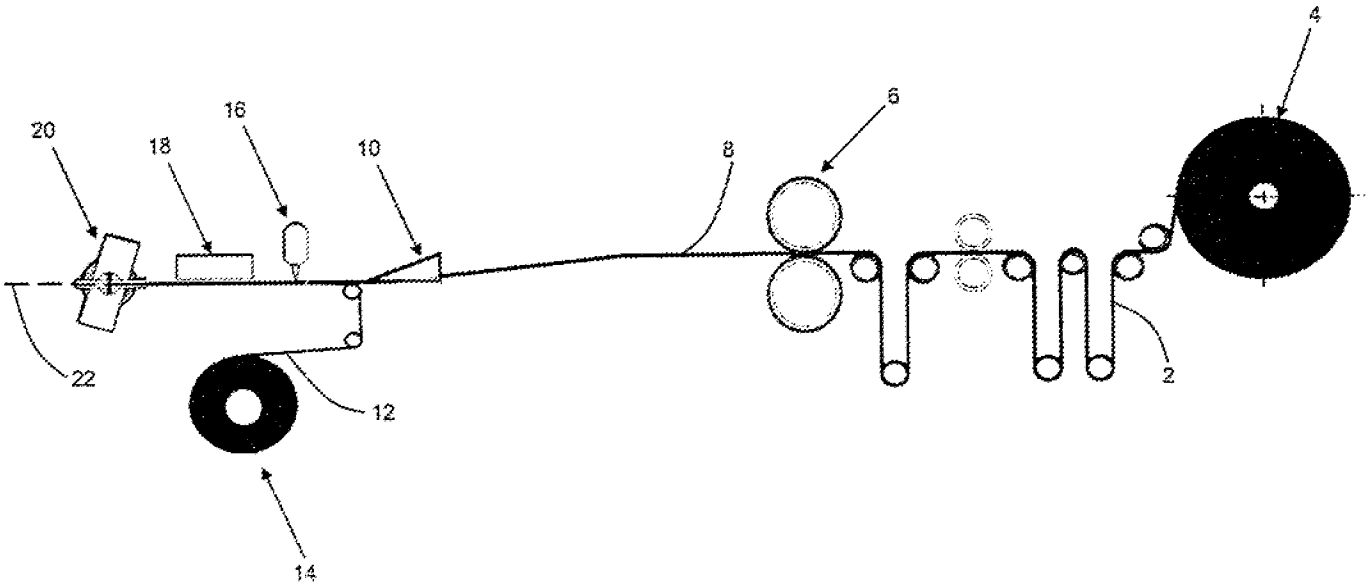
FIG. 1 shows a schematic cross-section of apparatus for forming a rod according to a specific embodiment.

The apparatus shown in FIG. 1 generally comprises: supply means for providing a continuous sheet of homogenised tobacco; crimping means for crimping the continuous sheet; rod forming means for gathering the continuous crimped sheet and circumscribing the gathered material with a thermally-conductive aluminium foil wrapper to form a continuous rod; and cutting means for severing the continuous rod into a plurality of discrete rods. The apparatus also comprises transport means for transporting the continuous sheet of material downstream through the apparatus from the supply means to the rod forming means via the crimping means.

As shown in FIG. 1, the supply means for providing a continuous sheet comprises a continuous sheet of homogenised tobacco 2 mounted on a bobbin 4. The crimping means comprises a pair of rotatable crimping rollers 6. In use, the continuous sheet of homogenised tobacco 2 is drawn from the first bobbin 4 and transported downstream to the pair of crimping rollers 6 by the transport mechanism via a series of guide and tensioning rollers. As the continuous sheet of homogenised tobacco 2 is fed between the pair of crimping rollers 6, the crimping rollers engage and crimp the sheet 2 to form a continuous crimped sheet of homogenised tobacco 8 having a plurality of spaced-apart ridges or corrugations substantially parallel to the longitudinal axis of the sheet through the apparatus.

The continuous crimped sheet of homogenised tobacco material 8 is transported downstream from the pair of crimping rollers 6 towards the rod forming means and fed through a converging funnel or horn 10. The converging funnel 10 gathers the continuous sheet of homogenised tobacco 8 transversely relative to its longitudinal axes. The sheet of material 8 assumes a substantially cylindrical configuration as it passes through the converging funnel 10.

Upon exiting the converging funnel 10, the gathered sheet of homogenised tobacco is wrapped in a continuous sheet of aluminium foil 12. The continuous sheet of aluminium foil is fed from a bobbin 14 and enveloped around the gathered continuous crimped sheet of homogenised tobacco material by an endless belt conveyor or garniture. As shown in FIG. 1, the rod forming means comprises an adhesive application means 16 that applies adhesive to one of the longitudinal edges of the continuous sheet of aluminium foil, so that when the opposed longitudinal edges of the continuous sheet of aluminium foil are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete rods of unit rod length or multiple unit rod length.

Figure 2:
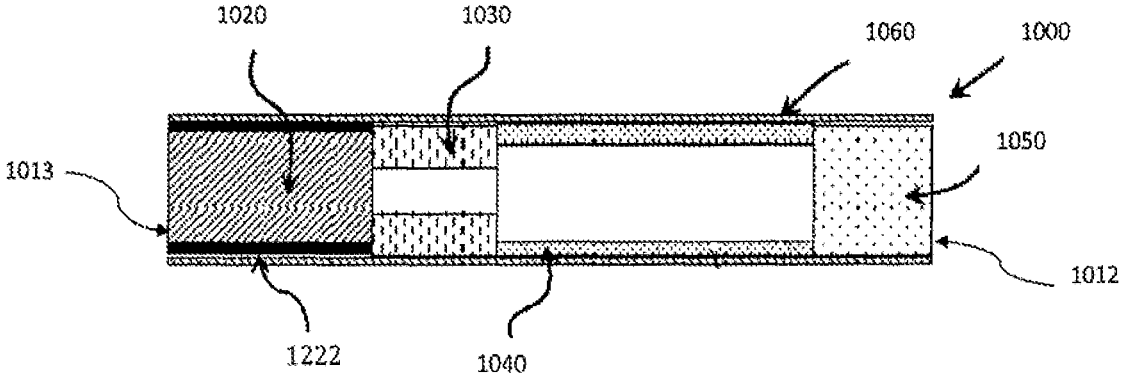
FIG. 2 illustrates an embodiment of an aerosol-generating article as described herein.

FIG. 2 illustrates an embodiment of a heated aerosol-generating article 1000 comprising a rod as described herein. The article 1000 comprises four elements; an aerosol-forming substrate 1020, a hollow cellulose acetate tube 1030, a spacer element 1040, and a mouthpiece filter 1050. These four elements are arranged sequentially and in coaxial alignment and are assembled by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 2 is particularly suitable for se with an electrically-operated aerosol-generating device comprising a heater for heating the aerosol-forming substrate.

When assembled, the article 1000 is about 45 millimetres in length and has an outer diameter of about 7.2 millimetres and an inner diameter of about 6.9 millimetres.

The aerosol-forming substrate 1020 comprises a rod formed from a crimped and gathered sheet of homogenised tobacco wrapped in aluminium foil 1222 to form a plug. A user may inadvertently attempt to ignite the aerosol-forming substrate 1020 by applying a flame to the distal end 1013 and simultaneously drawing air through the mouthpiece. Should this occur, the aluminium foil component of aerosol-forming substrate will swiftly spread the applied heat along the radial extremities of the aerosol-forming substrate, thereby making it more difficult to increase the homogenised tobacco component to its ignition temperature. This lowered propensity for ignition may be sufficient for the user to desist in the attempts to ignite the article.

An aerosol-generating article 1000 as illustrated in FIG. 2 is designed to engage with an aerosol-generating device in order to be consumed. Such an aerosol-generating device includes means for heating the aerosol-forming substrate 1020 to a sufficient temperature to form an aerosol. Typically, the aerosol-generating device may comprise a heating element that surrounds the aerosol-generating article 1000 adjacent to the aerosol-forming substrate 1020, or a heating element that is inserted into the aerosol-forming substrate 1020.

Figure 3:
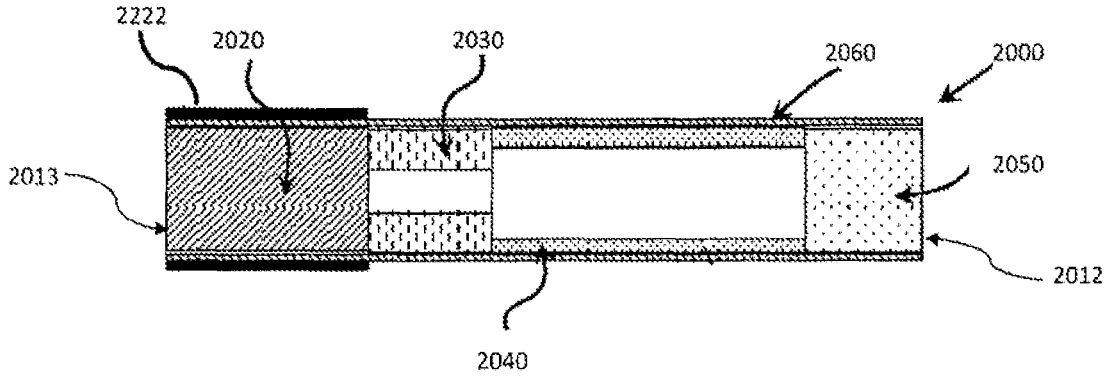
FIG. 3 illustrates an alternative embodiment of an aerosol-generating article as described herein.

Once engaged with an aerosol-generating device, a user draws on the mouth-end 1012 of the smoking article 1000 and the aerosol-forming substrate 1020 is heated to a temperature of about 375 degrees Celsius. At this temperature, volatile compounds are evolved from the sheet of cast-leaf tobacco of the aerosol-forming substrate 1020. These compounds condense to form an aerosol. The aerosol is drawn through the filter 1050 and into the user's mouth. FIG. 3 illustrates an alternative configuration of an aerosol-generating article. The article 2000 comprises four elements: an aerosol-forming substrate 2020, a hollow cellulose acetate tube 2030, a spacer element 2040, and a mouthpiece filter

2050. These four elements are arranged sequentially and in coaxial alignment and are assembled by a cigarette paper 2060 to form the aerosol-generating article 2000. The article 2000 has a mouth-end 2012, which a user inserts into his or her mouth during use, and a distal end 2013 located at the opposite end of the article to the mouth end 2012. The aerosol-forming substrate 2020 comprises a rod formed from a crimped and gathered sheet of homogenised tobacco wrapped in filter paper to form a plug. A sheet of aluminium foil 2222 encircles the aerosol-forming substrate externally to the cigarette paper 2060.

Figure 4:
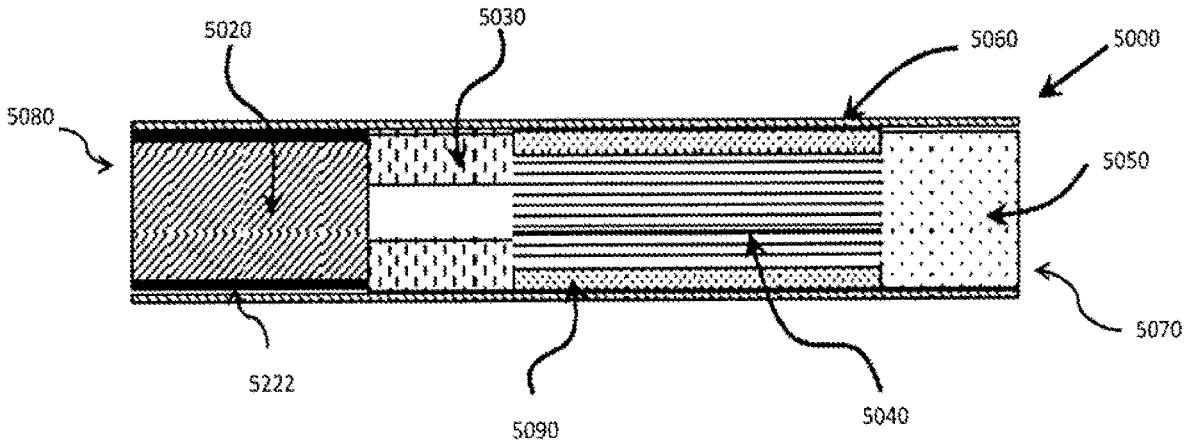
FIG. 4 illustrates an alternative embodiment of an aerosol-generating article as described herein.

FIG. 4 illustrates a further alternative configuration of an aerosol-generating article 5000. The aerosol-generating article 5000 comprises four elements arranged in coaxial alignment: an aerosol-forming substrate 5020, a support element 5030, an aerosol-cooling element 5040, and a mouthpiece 5050. These four elements are arranged sequentially and are circumscribed by an outer wrapper 5060 to form the aerosol-generating article 5000. The aerosol-cooling, element 5040 acts, as a spacer element as described in relation to FIG. 2 as well as an aerosol-cooling element. The aerosol-forming substrate 5020 comprises a rod formed from a crimped and gathered sheet of homogenised tobacco wrapped in aluminium foil 5222 to form a plug. The aerosol-generating 5000 has a proximal or mouth end 5070, which a user inserts into his or her mouth during use, and a distal end 5080 located at the opposite end of the aerosol-generating article 5000 to the mouth end 5070.

Figure 5:
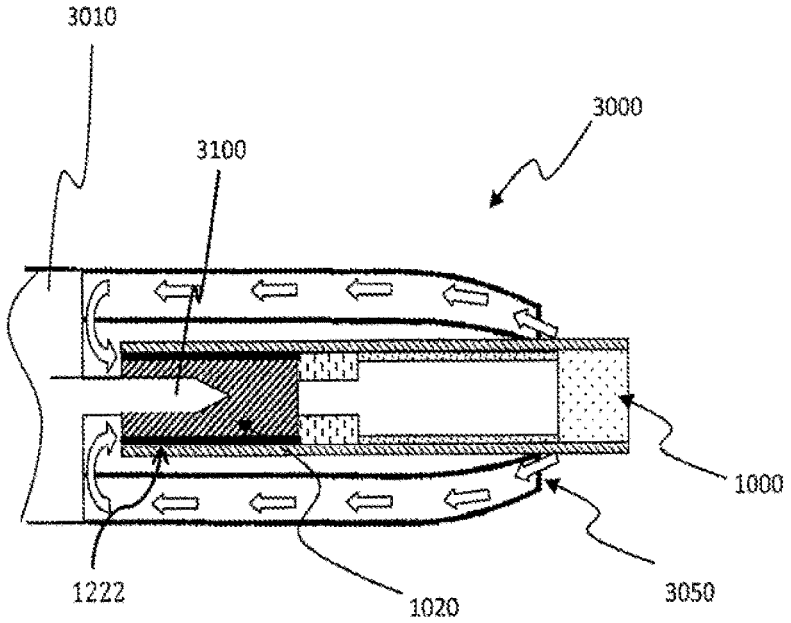
FIG. 5 illustrates an aerosol-generating system comprising an electrically-operated aerosol-generating device and an aerosol-generating article as illustrated in FIG. 2.
Figure 6:
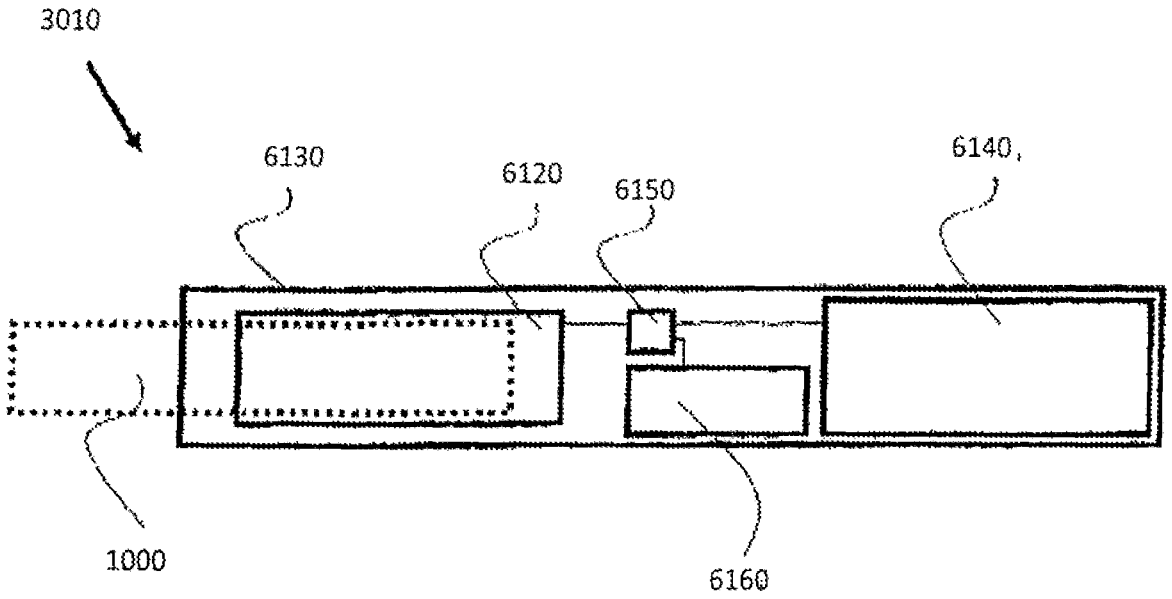
FIG. 6 is a schematic cross-sectional diagram of the electrically-operated aerosol-generating device illustrated in FIG. 5.

FIG. 5 illustrates a portion of an electrically-operated aerosol-generating system 3000 that utilises a heating blade 3100 to heat an aerosol-generating substrate 1020 of an aerosol-generating article 1000, 2000, 5000. The heating blade is mounted within an aerosol article receiving chamber of an electrically-operated aerosol-generating device 3010. The aerosol-generating device defines a plurality of air holes 3050 for allowing air to flow to the aerosol-generating article 1000. Air flow is indicated by arrows on FIG. 5. The aerosol-generating device comprises a power supply and electronics, which are illustrated in FIG. 6. The aerosol-generating article 1000 of FIG. 5 is as described above in relation to FIG. 2.

In FIG. 6, the components of the aerosol-generating device 3010 are shown in a simplified manner. Particularly, the components of the aerosol-generating device 3010 are not drawn to scale in FIG. 6. Components that are not relevant for the understanding of the embodiment have been omitted to simplify FIG. 6.

As shown in FIG. 6, the aerosol-generating device 3010 comprises a housing 6130. The heating element 6120 is mounted within an aerosol-generating article receiving chamber within the housing 6130. The aerosol-generating article 1000 (shown by dashed lines in FIG. 6) is inserted into the aerosol-generating article receiving chamber within the housing 6130 of the aerosol-generating device 3010 such that the heating element 6120 is directly inserted into the aerosol-forming substrate 1020 of the aerosol-generating article 1000.

Within the housing 6130 there is an electrical energy supply 6140, for example a rechargeable lithium ion battery. A controller 6150 is connected to the heating element 6120, the electrical energy supply 6140, and a user interface 6160, for example a button or display. The controller 6150 controls the power supplied to the heating element 6120 in order to regulate its temperature.

The exemplary embodiments described above are not limiting. In view of the above-discussed exemplary embodiments, other embodiments consistent with the above exemplary embodiment will now be apparent to one of ordinary skill in the art.

The invention claimed is:

1. An electrically operated aerosol-generating system, comprising:

an aerosol-generating device comprising an electrically powered heating element; and an aerosol-generating article comprising a plug of aerosol-forming substrate radially encircled by a sheet of thermally conductive material, wherein the thermally conductive material is a thermally conducting flame barrier configured to spread heat and to mitigate against a risk of ignition of the plug of aerosol-forming substrate when a flame is applied to the aerosol-generating article, a plurality of elements, assembled together with the plug of aerosol-forming substrate within a wrapper to form a rod, the rod having a mouth end and a distal end upstream from the mouth end, the plug of aerosol-forming substrate being disposed at the distal end of the rod, the plurality of elements comprising a spacer element disposed within the rod downstream of the plug of aerosol-forming substrate and a mouthpiece element extending upstream from the mouth end of the rod, wherein the aerosol-generating device is configured to receive the aerosol-generating article and the electrically powered heating element is configured to heat the plug of aerosol-forming substrate of the aerosol-generating article.

2. The electrically operated aerosol-generating system according to claim 1, wherein the plug of aerosol-foaming substrate, the spacer element, and the mouthpiece element are co-axially aligned, and wherein the spacer element encloses a channel configured to convey aerosol from the plug of aerosol-forming substrate downstream towards the mouthpiece element.

3. The electrically operated aerosol-generating system according to claim 1, wherein the wrapper radially encircles the sheet of thermally-conductive material.

4. The electrically operated aerosol-generating system according to claim 1, wherein the sheet of thermally conductive material radially encircles the wrapper.

5. The electrically operated aerosol-generating system, according to claim 1, wherein a portion of the thermally conductive material covers the distal end of the rod.

6. The electrically operated aerosol-generating system according to claim 1, wherein the sheet of thermally conductive material comprises a metal foil.

7. The electrically operated aerosol-generating system according to claim 6, wherein the sheet of thermally conductive material is a co-laminated sheet comprising aluminium foil and a second material.

8. The electrically operated aerosol-generating system according to claim 6, wherein the sheet of thermally conductive material is a sheet of co-laminated metal foil and paper, or is a sheet of co-laminated metal foil and reconstituted tobacco.

9. The electrically operated aerosol-generating systema according to claim 6, wherein the metal foil is aluminium foil.

10. The electrically operated aerosol-generating system according to claim 1, wherein the plug of aerosol-forming substrate comprises a gathered sheet of aerosol-forming material.

11. The electrically operated aerosol-generating system according to claim 1, wherein the plug of aerosol-forming substrate is a rod of cut filler.

12. The electrically operated aerosol-generating system according to claim 1, wherein the plug of aerosol-forming substrate comprises homogenised tobacco material comprising between 1% and 5% non-tobacco fibres on a dry weight basis.

13. The electrically operated aerosol-generating system according to claim 1, wherein the plug of aerosol-forming substrate comprises homogenised tobacco material having an aerosol former content of between 5% and 30% on a dry weight basis.

14. The electrically operated aerosol-generating system according to claim 1, wherein the aerosol-generating device comprises a source of electrical energy configured to supply electrical power to the electrically powered heating element.

15. The electrically operated aerosol-generating system according to claim 1, wherein the electrically powered heating element is configured to surround the aerosol-generating article.

16. The electrically operated aerosol-generating system according to claim 1, wherein the electrically powered heating element comprises an insertable heating element configured for insertion into the distal end of the rod and to heat the plug of aerosol-forming substrate.

* * * * *